US011910875B2

(12) United States Patent
Arana et al.

(10) Patent No.: US 11,910,875 B2
(45) Date of Patent: Feb. 27, 2024

(54) SHOE UPPER COMPRISING PROTRUSIONS

(71) Applicant: adidas AG, Herzogenaurach (DE)

(72) Inventors: Marc Illan Arana, Nuremberg (DE); Gaetan Saint-Andre, Nuremberg (DE); Sven Roewe, Erlangen (DE); Dominik Sandreuter, Aurachtal (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 17/302,680

(22) Filed: May 10, 2021

(65) Prior Publication Data

US 2021/0345725 A1 Nov. 11, 2021

(30) Foreign Application Priority Data

May 11, 2020 (DE) ..... 10 2020 205 893.8

(51) Int. Cl.
*A43B 5/02* (2006.01)
*A43B 23/02* (2006.01)

(52) U.S. Cl.
CPC ..... *A43B 5/025* (2013.01); *A43B 23/027* (2013.01); *A43B 23/0245* (2013.01)

(58) Field of Classification Search
CPC ..... A43B 5/02; A43B 5/025; A43B 23/027; A43B 23/047
See application file for complete search history.

(56) References Cited

U.S. PATENT DOCUMENTS 3,191,321 A * 6/1965 Brutting ..... A43B 5/02 36/77 R
5,437,112 A * 8/1995 Johnston ..... B29D 35/146 36/133
5,555,650 A * 9/1996 Longbottom ..... A43B 5/025 36/114
6,523,282 B1 * 2/2003 Johnston ..... A43B 5/02 36/133
8,789,298 B2 7/2014 Eder et al.
9,693,694 B2 7/2017 Halaka
2003/0167658 A1 * 9/2003 Davis ..... A43C 13/14 36/128
2006/0218821 A1 * 10/2006 Hatzilias ..... A43B 5/025 36/133
2010/0077637 A1 4/2010 Hatzilias
2010/0331122 A1 * 12/2010 Morag ..... A43B 5/025 473/422

(Continued)

FOREIGN PATENT DOCUMENTS

CN 206390385 U 8/2017
CN 207269957 U 4/2018

(Continued)

OTHER PUBLICATIONS

25 Years Old—Full Adidas Predator History—1994-2020 <https://web.archive.org/web/20201001004051/https://www.footyheadlines.com/2017/05/here-is-the-complete-history-of-the-adidas-predator.html>.

*Primary Examiner* — Sharon M Prange
(74) *Attorney, Agent, or Firm* — Sterne, Kessler, Goldstein & Fox P.L.L.C.

(57) ABSTRACT

An upper for a sports shoe includes a plurality of areas. The areas include a medial area, a lateral area, a toe area, an instep area, a heel area, and a collar area. The upper includes at least one protrusion in at least four of the plurality of areas. The protrusions protrude from an outer surface of the upper.

23 Claims, 4 Drawing Sheets

(56) References Cited

U.S. PATENT DOCUMENTS

| | | | | |
|---|---|---|---|---|
| 2011/0035963 | A1* | 2/2011 | Baker | A43B 13/40 36/114 |
| 2011/0247240 | A1* | 10/2011 | Eder | A43B 23/00 36/133 |
| 2011/0258883 | A1* | 10/2011 | Eder | A43B 5/02 36/133 |
| 2013/0074374 | A1* | 3/2013 | Droege | A43B 7/24 36/133 |
| 2013/0125417 | A1* | 5/2013 | Minami | A43B 23/088 36/83 |
| 2015/0128453 | A1* | 5/2015 | Oroszi | A43C 15/16 12/142 P |
| 2015/0201705 | A1* | 7/2015 | Doremus | A43D 8/22 2/69 |
| 2015/0342300 | A1* | 12/2015 | Cin | A43B 13/122 36/103 |
| 2016/0143395 | A1* | 5/2016 | Van Atta | A43B 23/028 36/48 |
| 2016/0270478 | A1 | 9/2016 | Doremus et al. | |
| 2016/0331065 | A1* | 11/2016 | Lam | A43B 23/026 |
| 2017/0071291 | A1* | 3/2017 | Follet | A43B 23/028 |
| 2018/0184760 | A1* | 7/2018 | Doremus | A43B 23/0245 |
| 2021/0085018 | A1* | 3/2021 | Chen | A43B 5/025 |
| 2021/0204640 | A1* | 7/2021 | Oroszi | A43B 5/025 |

FOREIGN PATENT DOCUMENTS

| | | | | |
|---|---|---|---|---|
| DE | 202010017958 | U1 * | 8/2013 | A43B 23/0235 |
| EP | 1 430 801 | A1 | 6/2004 | |
| EP | 2659798 | A1 * | 11/2013 | A43B 23/0235 |
| EP | 3 053 467 | A1 | 8/2016 | |
| JP | 59-86103 | U | 6/1984 | |
| JP | 2016-185380 | A | 10/2016 | |
| WO | 2007/144331 | A1 | 12/2007 | |
| WO | 2010/055276 | A1 | 5/2010 | |
| WO | 2010/086672 | A1 | 8/2010 | |
| WO | 2012/125333 | A2 | 9/2012 | |
| WO | WO-2017025111 | A1 * | 2/2017 | |
| WO | WO-2019220157 | A1 * | 11/2019 | A43B 23/0235 |

* cited by examiner

SHOE UPPER COMPRISING PROTRUSIONS

TECHNICAL FIELD

Embodiments of the present invention relate to an upper for a shoe comprising protrusions, especially to protrusions with a particular arrangement on the upper.

BACKGROUND

Sports shoes have to meet a plurality of requirements. In addition to good wearing comfort, they must support an athlete as well as possible. Especially in sports where a ball is used, like soccer or rugby, an upper for a shoe must be designed in such a way that an optimal foot-to-ball contact is provided. A key aspect is a customized friction between the upper for a shoe and the ball for an improved ball control.

With the help of a variety of applications applied to the upper of a sports shoe, energy transfer during kicking can be optimized. These applications allow the athletes to perform special tricks like giving the ball a spin. These applications are mostly made of rubber and are only distributed over certain areas of the upper of a shoe where the main contact with the ball occurs.

For example, WO 2010/086672 A1 relates to a sports shoe, wherein the upper of the sports shoe comprises deformable protrusions in the forefoot region which comprise a form of a suction cup.

CN206390385U is directed to a training sports shoe with an outer layer of highly elastic rubber, which is distributed on the outer surface in a form of small rubber cylindrical projections.

CN207269957 relates to soccer shoes with a high speed ball control, wherein an upper is provided with protrusions comprising a small circular suction cup.

U.S. Pat. No. 9,693,694 B2 is directed to an article of footwear, wherein the outsole may include lateral and medial arch portions for traction.

EP 1430801 A1 relates to an article of footwear such as a soccer shoe which includes a ball control region. The ball control region comprises a series of raised geometric protrusions of various sizes that are arranged on the upper of the soccer shoe.

WO 2010/055276 A1 is directed to a ball control component for a sports shoe, wherein the upper surface of the ball controlling portion is provided with a plurality of diamond shaped pieces of rubber.

SUMMARY OF THE INVENTION

Based on the background discussed above, it is a purpose of the present disclosure to provide a shoe for ball sports, in particular for soccer, with improved grip that allows for improved ball control. Moreover, it is a goal of the present disclosure to provide a shoe for ball sports, in particular for soccer, with an improved fit.

The above mentioned objectives are met by an upper for a sports shoe that includes a plurality of areas comprising: a medial area, a lateral area, a toe area, an instep area, a heel area, and a collar area, wherein the upper comprises at least one protrusion in at least four of the plurality of areas, and wherein the protrusions protrude from an outer surface of the upper. The fact that the protrusions are distributed not only on limited areas but extend to many areas of an upper of a sports shoe leads to improved ball control all over the sports shoe. As many areas of the upper comprise grip and damping elements, a much more creative way of playing is possible. The athlete is therefore able to interact with the ball not only with the front area and sides of the shoe but also with the heel area or the instep area. This leads to many new ways of handling the ball and performing special tricks or feints as well as enhancing the ball spin.

The upper may comprise at least one protrusion in each of the plurality of areas. In this way, the advantageous effects of the present disclosure are even more pronounced.

The upper may comprise at least one protrusion in the medial area, the lateral area, the toe area, and the instep area. By distributing protrusions in these areas, the ball control can be further improved. The combination of having protrusions in the medial, lateral, toe and instep area specifically supports ball control while kicking the ball in order to score a goal. The distribution in the mentioned areas enables more precise goal shots.

The upper may comprise at least one protrusion in the medial area, the lateral area, the toe area, the instep area and the heel area. By distributing protrusions in these areas, the ball control can be even further improved, both for shooting and for performing tricks. Many tricks or feints of soccer players involve guiding the ball around the heel of the player. Having protrusions in the heel area as well further supports the player's ability to perform tricks and feints.

According to the present disclosure, the at least one protrusion in a first of the plurality of areas may differ from the at least one protrusion in a second of the plurality of areas in their dimension and/or shape and/or orientation. To provide an improved functional performance of a sports shoe, different areas of the sports shoe should have particular and varied characteristics and therefore allow optional ball control. In the kicking area, a maximum energy transfer is desired, whereas in the heel area, a better ball control is required when performing tricks. In some areas it should be easy for the athlete to give the ball a spin, and in other areas a sideways movement of the ball should be avoided.

The upper may comprise a plurality of protrusions in a first and a second of the plurality of areas, and the distribution density of the protrusions in the first area may differ from the distribution density of the protrusions in the second area. Different distribution densities lead to different cushioning behavior and ball control. Thus, a varying response to ball contact is possible by varying the distribution density of the protrusions. Further, by adjusting the distribution density of the protrusions in different areas, a stretchability of the upper can be tuned. If a base material of the upper in a first area is flexible, a high distribution density leads to a first area with less stretch. A low distribution density leads to a first area with more stretch.

The upper may comprise at least two protrusions in at least one of the plurality of areas, and the at least two protrusions may differ in their dimension and/or shape and/or orientation. With at least two protrusions which differ in their dimension and/or shape and/or orientation in an area, it is possible to tune characteristics of each of the plurality of areas very individually. This also enables a customization of the products to meet individual player needs.

The upper may comprise a plurality of protrusions in at least one of the plurality of areas, and the protrusions may be unevenly distributed in the at least one area. The transition from one area to another may require an adjustment of the density of the protrusions so that they are unevenly distributed within an area. The uneven distribution is not random and it is possible to engineer the pattern for certain functions. For example, the pattern could have a kind of "flow" or generally a dynamic appearance. In this way, channels may, for example, be formed by the protrusions through which moisture is better removed from the surface of the upper. As air flows may be created through these channels during a dynamic movement, water is more effectively displaced from the surface of the upper.

The upper may comprise a plurality of protrusions in at least one of the plurality of areas, and two adjacent protrusions in the at least one area may comprise essentially the same orientation. In the context of the present disclosure, this is to be understood in that symmetry axes of adjacent protrusions may be aligned within a tolerance of a few degrees, for example within ten degrees, or more preferably within five degrees. The alignment of one protrusion relative to an adjacent protrusion leads to areas with similar orientations of the protrusions. In this way, a streamlined orientation is possible. However, on a larger scale, the alignment of the protrusions may differ by more than just a few degrees.

In the context of the present disclosure, two non-adjacent protrusions in the at least one area may comprise different orientations. By slowly changing the orientation, curved channels can be formed. A targeted removal of moisture can be achieved via these curved channels. Further visual effects may be created which can help to identify players on the field.

The upper may comprise a base material which forms a mounting for the at least one protrusion. The upper may be formed by the base material alone. Alternatively, the base material may cover an underlying layer of the upper. Such an underlying layer may be an inner lining, for example a textile lining which is in contact with a foot when the shoe is worn.

The base material may form the outer surface of the upper. Depending on the material of the protrusions, the base material can be selected to ensure ideal bonding. This allows providing protrusions in different areas of the upper even if the underlying material in those areas may differ. Alternatively, the base material may be covered at least partly by a coating layer. Such a coating layer may be arranged on an outer side of the base layer and provides additional properties, like additional abrasion resistance. The coating layer may form the outer surface of the upper, at least in some areas. This allows providing protrusions with ideal bonding in different areas of the upper, for example, in areas where the base material forms the outer surface and/or in areas where the coating layer forms the outer surface of the upper. The protrusions may be provided directly on the base material and/or directly on the coating layer.

The base material of the upper may comprise a textile and/or a synthetic material. Depending on the material of the protrusion, the base material may comprise a textile or synthetic material to ensure ideal bonding.

The base material of the upper may comprise a first stretchability in a first of the plurality of areas and a second stretchability in a second of the plurality of areas. The first and second stretchabilities may be different. Different stretchability characteristics of the base material in different areas improve the functionality of the shoe. For example, the instep area may require a higher flexibility than the kicking area.

The protrusions may comprise rubber, and/or casting polyurethanes (CPU), and/or silicon. Depending on the desired degree of energy transfer, a softer or harder material may be used. This allows fine-tuning the response of the shoe upper to a ball. In addition, the choice of the material for the protrusions may depend on the base material or the underlying material of the upper to achieve a good bonding. The usage of protrusions made of rubber and protrusions made of CPU on one shoe upper enables fine-tuning and customizing grip and ball control.

The protrusions in the lateral area, the medial area, and the toe area may comprise rubber. Rubber provides a high energy transfer, which is preferable in the kicking area. In addition, the base material of these areas may comprise coated textile or foiled textile such that a solid bonding to the rubber materials may be provided.

The protrusions in the instep area, the heel area, and the collar area may comprise CPU and/or silicon. A softer material increases the cushioning characteristic of the shoe upper, which may be desired by an athlete when performing tricks. The base material of these areas may comprise a textile, e.g., knitted, meshed or Lycra materials. Compared to rubber materials, CPU, and/or silicon materials in general have better bonding properties with textiles.

The present disclosure also relates to a shoe comprising an upper as described herein and a sole attached to the upper.

Another aspect of the present disclosure relates to an upper for a sports shoe, which comprises at least one protrusion on an outer surface of the upper, wherein the at least one protrusion comprises a deltoid-shaped or circular base area and forms at least one peak extending from the outer surface of the upper. The shape of the protrusions directly influences the friction. With this special shape, the friction coefficient can be optimized so that the athlete gets an advantage. By this, a shoe upper is provided which provides much more control when kicking a ball. When kicking a ball, the protrusions interact with the surface of a ball, whereby the friction between the shoe upper and the ball, and consequently ball control, will be enhanced.

The deltoid-shaped base area may comprise a convex deltoid and/or a concave deltoid. Both deltoid forms positively influence the friction in foot-to-ball interaction.

The deltoid-shaped base area may comprise two adjacent sides of a first length and two adjacent sides of a second length differing from the first length. For example, the deltoid-shaped base area may have a shape of a kite. It is important to clarify that an ordinary diamond shape has a different friction compared to a real deltoid shape. Having deltoid-shaped base areas compared to ordinary diamond-shaped base areas gives much more freedom to design the protrusions in a way that they can interact with a ball in a beneficial way.

The at least one protrusion may comprise at least one notch such that the at least one protrusion comprises at least two peaks. The maximum energy transfer is realized with one peak. However, if the athlete does not only want to kick the ball but also wants to perform tricks, whereby a greater cushioning of the ball on the shoe is required, several peaks are advantageous.

The upper may comprise at least one protrusion in each of a medial area, a lateral area, an instep area, a heel area, a collar area, and a toe area. The distribution of the protrusions over the entire shoe allows 360° control over the ball.

The at least one protrusion in different areas may comprise different shapes and/or materials. Depending on the area of the upper, a certain shape and material is desired. For example, within the kicking zone, a different shape and material is required than in areas that are not intended for kicking, such as where the ball may, for example, be required to be balanced as long as possible on the upper.

The at least one protrusion in the lateral area, the medial area, and the toe area may comprise one peak, and the at least one protrusion in the instep area and the heel area may comprise at least one peak. By adjusting the number of peaks the at least one protrusion comprises, the cushioning or absorption effect of the shoe upper can be customized according to the athlete's preferences.

The at least one protrusion may comprise rubber and/or casting polyurethane (CPU) and/or silicon. In addition to the shape, the elasticity of the material plays an important role. Depending on whether the impulse of the ball is to be maintained as far as possible or weakened, different materials are used for creating the protrusions.

The at least one protrusion in the lateral area, the medial area, and the toe area may comprise rubber. Rubber is characterized by a high energy transfer, which is required in the lateral area, the medial area, and the toe area.

The at least one protrusion in the instep area, the heel area, and the collar area may comprise CPU and/or silicon. These areas have different requirements because, for example, the control of the ball is the main focus and a maximum impulse transfer is not required. Therefore, CPU and/or silicon are used in these areas.

The at least one protrusion of the upper may be flexible. Flexible protrusions may provide better absorption of the impact from a ball.

The upper may comprise at least two protrusions with different hardness. The hardness also has an influence on how an impact of a ball is absorbed by the shoe upper.

The present disclosure also relates to a shoe comprising an upper as described herein and a sole attached to the upper.

Another aspect of the present disclosure relates to an upper for a sports shoe, which comprises an instep portion and a collar portion, wherein the collar portion is partly connected to the instep portion, such that the collar portion partially overlaps the instep portion. In particular, the instep portion and the collar portion are advantageously separate pieces connected to each other only at selected points or areas. The gap between the instep portion and the collar portion, in the areas that are not connected, allows the upper to easily stretch when a user is stepping in the shoe. The advantage of this aspect of the disclosure is a shoe providing comfortable wearing, which allows an easy step-in and a secure lockdown at the same time, especially for mid-cut shoes, i.e. shoes that at least partially cover the ankle of the wearer. In addition, the secure lockdown may be realized without laces.

The instep portion may comprise an edge and the collar portion may be connected to the instep portion at a part of the edge. The edge of the instep portion may be connected to the collar portion in the ankle area or lower at the heel area. Due to this connection, the partial overlapping of the collar portion and the instep portion is achieved as well as a secure support in the ankle area. With the aid of the stretchable overlap an easy step-in can be realized.

On the overlapping area, the collar portion may define an external surface of the shoe upper, while the instep portion may define an internal surface.

The collar portion may comprise a rim and part of the rim of the collar portion may be connected to the instep portion.

Alternatively, or in addition to the connection of the edge of the instep portion to the collar portion, the collar portion, and in particular the rim of the collar portion, may be connected to the instep portion at a midfoot area of the upper. With the aid of this connection, the instep portion fits tightly at the backside of the foot. Moreover, thanks to this connection, the collar portion is brought to adhere more tightly to the Achilles tendon and to the heel of the foot of the wearer when the instep portion is pushed forward by the foot of the wearer, for instance while the wearer is running or performing abrupt movements with the foot. Therefore, the shoe remains on the foot even under heavy strain such as sprinting or kicking a ball.

The collar portion and/or the instep portion may be made of a textile material and, preferably, of a knitted textile. This allows precisely engineering the shape of the collar portion and/or the instep portion while reducing production waste material.

The collar portion may comprise a first piece and a second piece. The division of the collar portion allows a more precise shaping of the collar portion with respect to the anatomy of the foot and leads to a better distribution of the forces acting on the material under strain.

The first piece may be arranged at a medial side of the upper and the second piece may be arranged at a lateral side of the upper. The connection of the enclosed heel area with the medial and lateral side of the shoe provides a secure wearing comfort and a tight fit.

The first piece and the second piece may be at least partly connected at a heel area of the shoe upper. The first piece may be partly connected to the instep portion at the medial side of the upper, and the second piece may be partly connected to the instep portion at the lateral side of the upper. The special design and arrangement, as well as the connection, of the three pieces of the textile and in particular of the knitted textile (first piece, second piece, and instep portion) lead to the advantageous effect that a 3D construction of the shoe upper around the instep and also around the Achilles tendon and on the heel area is formed, which can be accomplished without complicated knitting techniques. Therefore, a stable 3D construction can be realized by simply using and connecting pieces of knitted fabrics.

A distance between the rim of the collar portion and a sole portion of the upper may increase from a midfoot area of the upper to a heel area of the upper. Particularly, in a rearfoot area of the shoe, the distance between the rim of the collar portion and the sole portion may be greater than a distance between the instep portion and the sole portion. More clearly, in a rearfoot area, the collar portion may extend higher than the instep portion in the midfoot area. With the special design and arrangement of the collar portion and the instep portion of the upper, the area of the Achilles tendon of a wearer can be covered and protected by the upper when the shoe is worn, while the front part of the ankle can remain uncovered and allow more freedom of movement.

Therefore, the collar portion may be adapted to cover a wearer's Achilles tendon at least partially. This partial covering of the wearer's Achilles tendon ensures that this area is protected. On the other hand, this construction also leads to an easier step-in and a more stable fit once the shoe is worn.

As previously specified, the upper may comprise a knitted fabric. The usage of knitted fabrics has several advantages such as a comfortable wearing provided by an optimal alignment to a given foot shape and an even better protection to the athlete's foot from injuries provided by the high degree of flexibility of the knitted fabrics.

The upper may be a lace-less upper. With a lace-less upper the athlete saves time while putting on a shoe and it becomes easier to clean the shoe. In addition, it avoids the possibility that the laces might tangle and result in accidents or injuries, and also avoids the problem of a sudden unfastening of the laces during performing exercises.

The present disclosure also relates to a shoe comprising an upper as described herein and a sole attached to the upper.

BRIEF DESCRIPTION OF THE FIGURES

In the following, exemplary embodiments of the present disclosure are described with references to the figures.

DETAILED DESCRIPTION

Various embodiments of the present disclosure will be described in the following detailed description primarily with reference to a sports shoe. It is emphasized that the present disclosure is not limited to the specific embodiments set forth below.

Reference is further made to the fact that in the following paragraphs, various embodiments of the present disclosure are described in more detail. A person of ordinary skill in the art will understand, however, that the features and possible modifications described with reference to these specific embodiments may also be further modified and/or combined with one another in a different manner or in different sub-combinations, without departing from the scope of the present disclosure. Individual features or sub-features may also be omitted, if they are dispensable to obtain the desired result. In order to avoid redundancies, reference is therefore made to the explanations in the preceding sections, which also apply to the following detailed description.

Figure 1A:
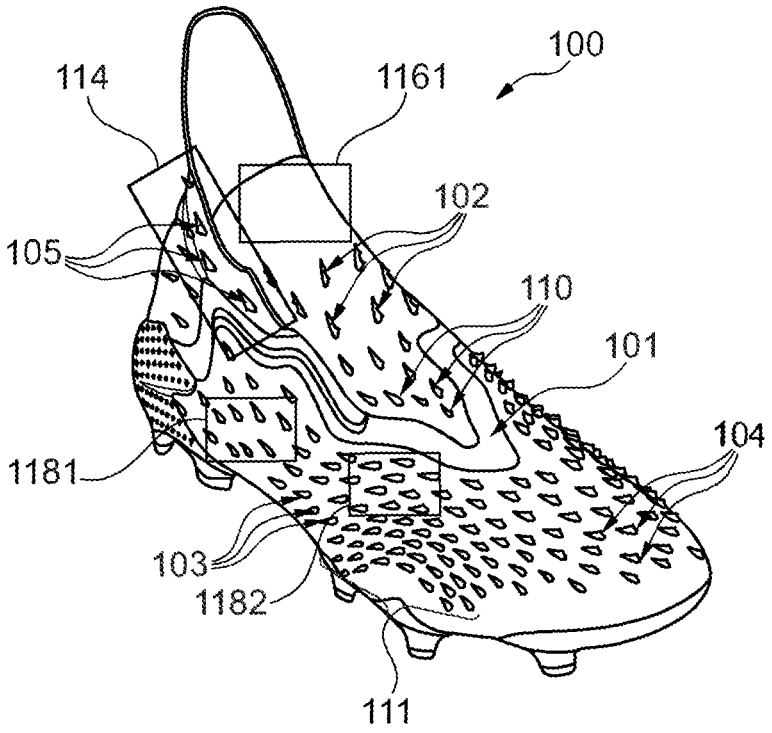
FIG. 1A shows an isometric view of a sports shoe according to some embodiments.
Figure 1B:
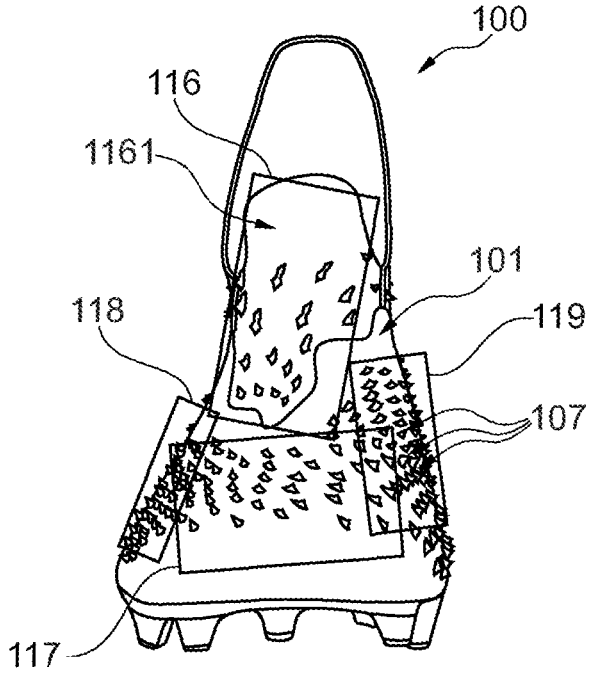
FIG. 1B shows a front view of a sports shoe according to some embodiments.
Figure 1C:
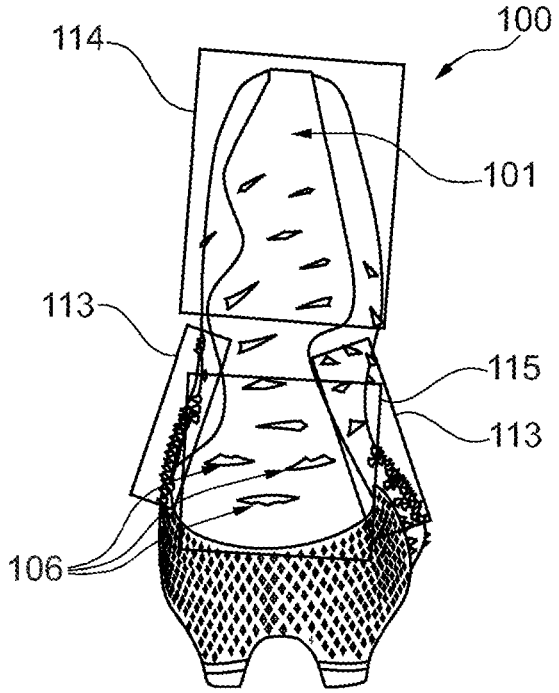
FIG. 1C shows a back view of a sports shoe according to some embodiments.

FIGS. 1A, 1B, and 1C show an upper 101 of a sports shoe 100 according to some embodiments of the present disclosure, respectively from the lateral side, the front, and the back of the shoe. The upper 101 comprises a plurality of protrusions 102 and 110 in an instep area 116, a plurality of protrusions 103 in a lateral area 118, a plurality of protrusions 104 in a toe area 117, a plurality of protrusions 107 in a medial area 119, a plurality of protrusions 105 in a collar area 114, and a plurality of protrusions 106 in a heel area 115. The protrusions protrude from an outer surface of the upper 101 and are flexible such that they are able to deform when they come in contact with, for instance, a ball.

All protrusions in the lateral area 118, the medial area 119, and the toe area 117 have one peak and comprise rubber, preferably a rubber material with a very light weight composition. The protrusions 102 and 110 in the instep area 116 have either one peak (such as protrusions 110) or two peaks (such as protrusions 102), and the protrusions 106 in the heel area 115 and the protrusions 105 in the collar area 114 have one, two, or three peaks. The protrusions 102 and 110 in the instep area 116, the protrusions 106 in the heel area 115, and the protrusions 105 in the collar area 114 comprise casting polyurethane (CPU). In some embodiments, the protrusions in these regions may comprise silicon.

In some embodiments, the upper 101 is made of a flexible base material, which is not uniform over the whole sports shoe 100. Depending on the required elasticity of a particular area of the sports shoe 100, the base material may comprise different materials. In the medial area 110, the lateral area 118, and the toe area 117 the base material comprises a textile. In these areas, the textile base material is at least partly covered with a coating layer. In some embodiments, this coating layer may comprise a foil, preferably a polyurethane foil. The base material in the collar area 114, the heel area 115, and the instep area 116 comprises a textile. In some embodiments, the textile may comprise a knitted material, a meshed material, and/or a material made of elastane. In some embodiments, the textile base material in the collar area 114, the heel area 115, and the instep area 116 is not covered by a coating layer, and the textile base material forms the outer surface of the upper 101.

The protrusions are unevenly distributed on the upper 101, either in one of the plurality of areas or in two areas in comparison. In the lateral area 118 and the medial area 119, a density of the protrusions differs noticeably. For example, as shown in FIG. 1A, the lateral area 118 comprises a region 1181 with a lower distribution density of protrusions and a region 1182 with a higher distribution density of protrusions. As for a sports shoe, particularly a soccer shoe, the region 1181 is close to what is commonly understood in the technical field as the quarter region, and the region 1182 is closer to what is usually known as a midfoot region. The medial area 119 can have a similar arrangement of the protrusions.

Within each one of the plurality of areas of the upper, the alignment of the protrusions is specially designed to provide an optimal ball control effect. The alignment of one protrusion is essentially based on the alignment of an adjacent protrusion. This configuration leads to a streamlined orientation of the protrusions within each area and also all over the whole upper. In the transition from the lateral area 118 to the toe area 117, the arrangement and orientation of the protrusions can be described as segments 111 of concentric circles.

The protrusions 105, 106 in the heel area 115 and the collar area 114 comprise an increased size in comparison with the protrusions 102, 110, 103, 104, 107 in other areas 116, 117, 118, and 119.

In the context of the present disclosure, referring to FIG. 1C, the heel area 115 is defined to further comprise the ankle areas 113 which should be understood as the areas around the ankle of an athlete while wearing the sports shoe. In some embodiments, the protrusions in the ankle areas 113 also comprise CPU, similar to the protrusions 106 in the heel area 115. In contrast to a conventional sports shoe, the additional CPU protrusions in the ankle areas 113 provide shock absorption and therefore additional ankle/malleolus protection.

In some embodiments, the sports shoe is a lace-less shoe and thus there are no laces in the instep area 116. The additional free space on the instep area 116 can be used to arrange more CPU protrusions for increasing friction while kicking the ball and therefore enhances spin of the ball. In some embodiments, the protrusions can be made of silicon. Alternatively, the sports shoe may have laces in the instep area 116 and optionally have less protrusions or no protrusions in the instep area 116.

The instep area 116 can comprise a tongue area 1161, which is generally understood as the top region of the instep area 116 near the ankle of a user while wearing the sports shoe. The upper can further have protrusions in the tongue area in addition to the protrusions 102, 110 in the instep area 116. Alternatively, there might be no protrusions in the tongue area, as shown in FIGS. 1A and 1B, to provide an easier step-in when wearing the sports shoe.

Figure 2:
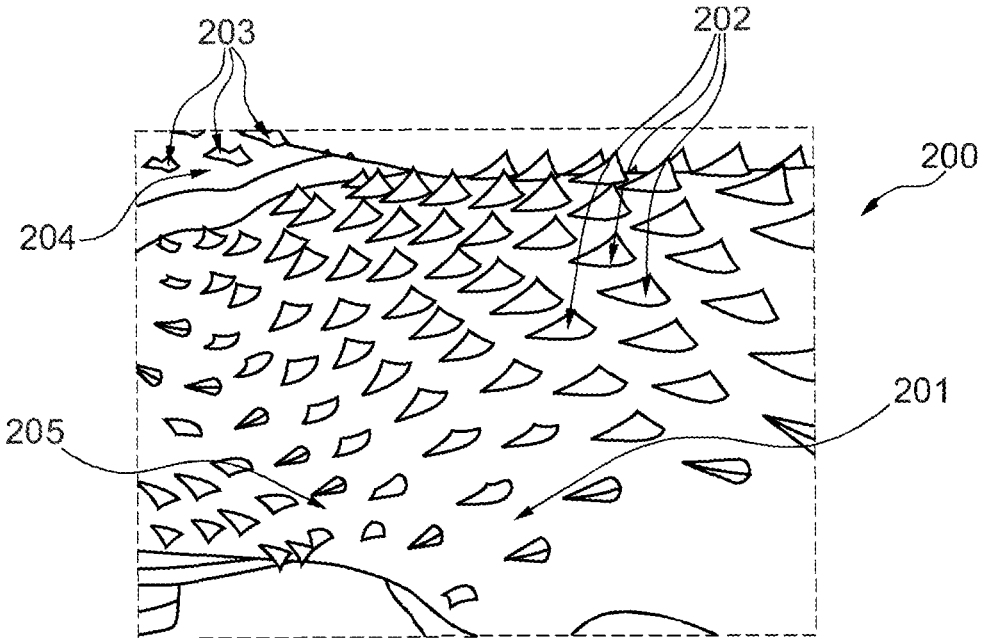
FIG. 2 shows an upper for a sports shoe with a plurality of protrusions having a shape according to some embodiments.

FIG. 2 shows an upper 201 of a sports shoe 200 according to some embodiments. The upper 201 comprises a base material which can comprise a textile and/or a synthetic material.

In some embodiments, as shown in FIG. 2, the base material comprises a textile. In particular, the base material comprises in region 204 a knitted material, e.g., a flat knit fabric, and in region 205 a coating layer on top of the textile base material. In addition, the base material can also comprise a non-knitted material such as a mesh material or a material made of elastane in other regions. For example, in some embodiments, the coating layer on top of the base material in region 205 may comprise a foil, preferably a polyurethane foil.

The upper 201 comprises a plurality of protrusions 202 with one peak and a plurality of protrusions 203 with two peaks. The protrusions have a convex deltoid-shaped base area. A convex deltoid-shaped base area corresponds to a kite-shaped base area. In general, a deltoid comprises two adjacent sides having a first length and two opposing sides having a second length different than the first length. In some embodiments, the base area can have a concave deltoid shape or a circular shape. In some embodiments, all protrusions, and in particular the protrusions with two peaks, have at least one concave increase. This refers to the concave rise between two peaks.

The protrusions with one peak 202 are located in the region 205 of the upper 201 and comprise rubber. The protrusions with two peaks 203 are located in the region 204 of the knitted material and comprise CPU. In some embodiments, CPU can be replaced by silicon.

Figure 3A:
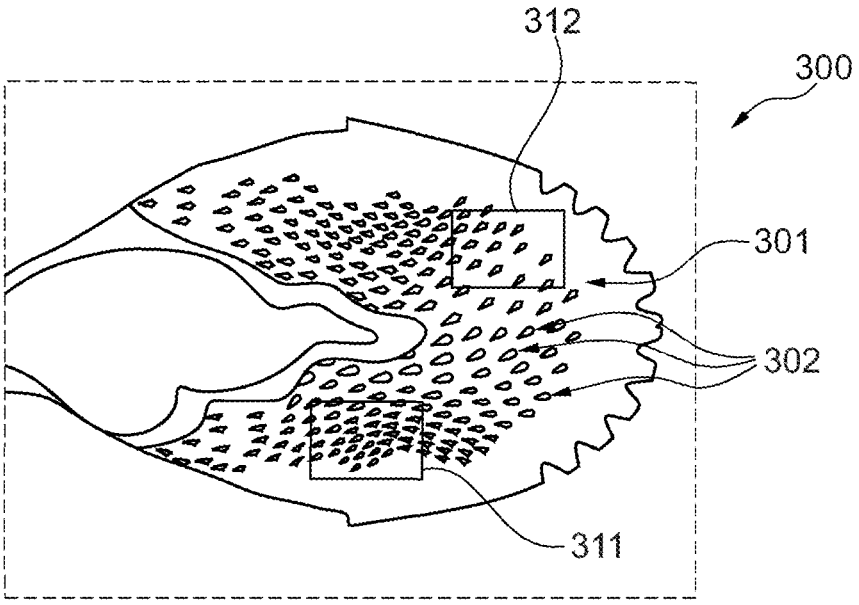
FIG. 3A shows an outer surface of an upper for a sports shoe with a plurality of protrusions having a shape according to some embodiments.

FIG. 3A shows an upper 300 for a sports shoe. The upper 300 comprises a coated textile, namely a textile base material with a coating layer, with a plurality of protrusions 302. The protrusions 302 have a convex deltoid-shaped base area and one peak. The protrusions 302 are unevenly distributed on an outer surface of the upper 300. Accordingly, the upper 300 comprises regions with different distribution densities of the protrusions. For example, the distribution density of the protrusions in region 311 is higher than the distribution density of protrusions in region 312. The distribution and orientation of the protrusions lead to a pattern which corresponds to a structured profile.

Figure 3B:
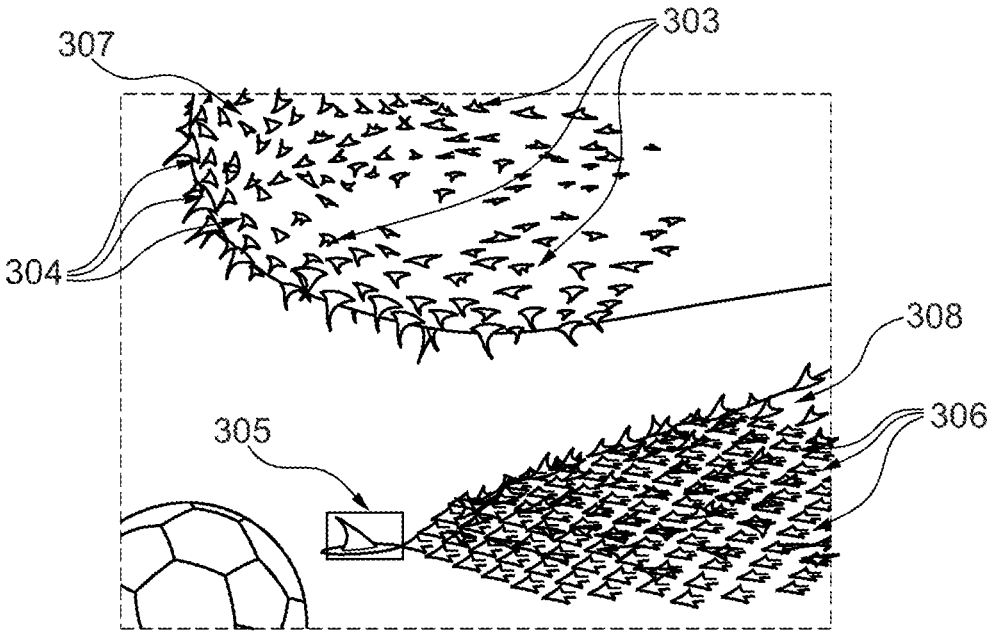
FIG. 3B shows a graphical illustration of an outer surface of an upper for a sports shoe with a plurality of protrusions having a shape according to some embodiments.

FIG. 3B shows a further embodiment of the present disclosure. On a first surface 307, protrusions formed thereon have a circular base area, such as protrusions 303, 304, 305. On a second surface 308, protrusions formed thereon partly have a concave deltoid-shaped base area, such as protrusion 306. The protrusions having a circular base area can comprise one peak, such as protrusion 304, or two peaks, such as protrusion 303. The peaks can be described as sharp cones curved in one direction, so that they resemble a stinger as shown in more detail with protrusion 305.

Figure 4A:
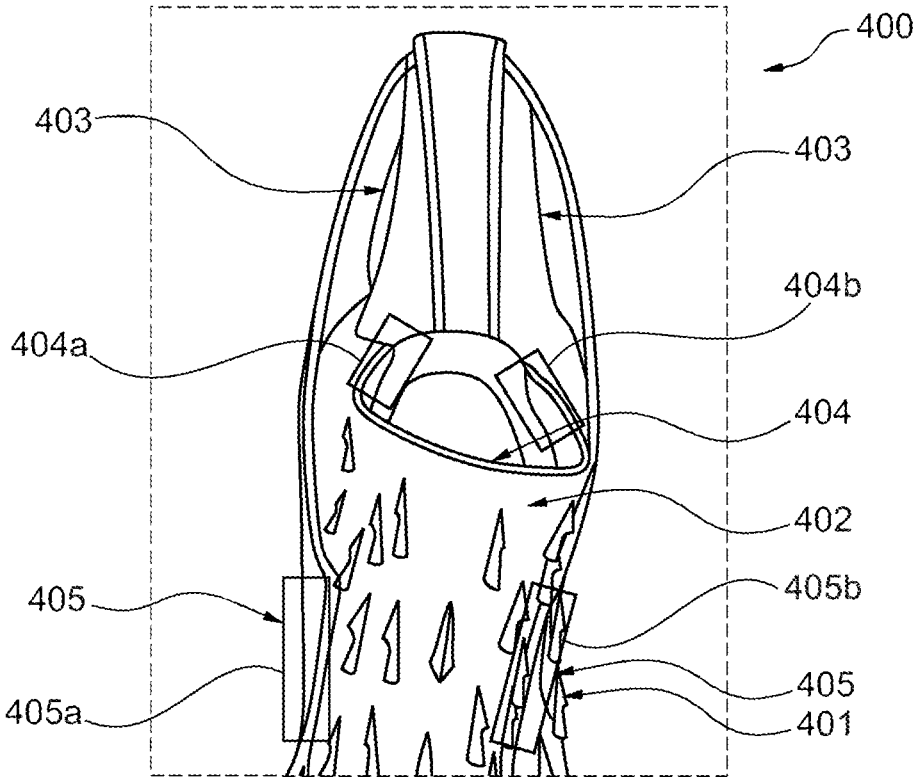
FIG. 4A shows a top isometric view of an upper for a sports shoe according to some embodiments.
Figure 4B:
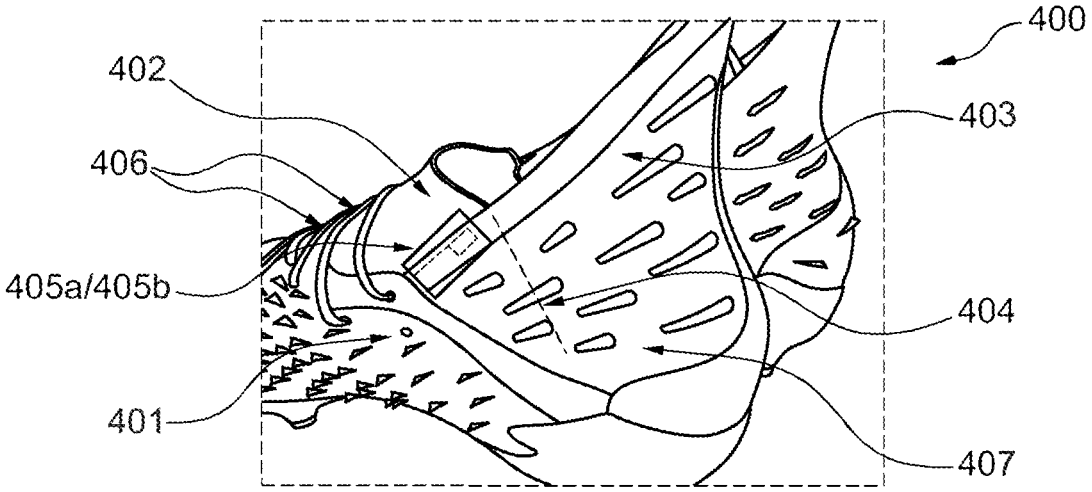
FIG. 4B shows an isometric side view of an upper for a sports shoe having laces according to some embodiments.

FIGS. 4A and 4B illustrate another aspect of the present disclosure. FIG. 4A shows a lace-less upper 401 of a sports shoe 400. FIG. 4B shows an upper 401 of a sports shoe 400 with laces 406. It should therefore be understood that the laces 406 are optional. Both the upper on FIG. 4A and the upper on FIG. 4B are, in particular, mid-cut uppers, i.e. uppers intended to cover at least partially the ankle of a wearer wearing the shoes.

The upper 401 comprises a collar portion 403 and an instep portion 402. As shown in FIG. 4A, the collar portion 403 can be understood as a portion extending around at least part of the opening of the shoe used by the user to wear the shoes and covering at least part of the heel of a wearer. In particular for mid-cut shoes, as the ones illustrated in FIGS. 4A and 4B, and for high-cut shoes, the collar portion 403 is intended to at least partially cover the Achilles tendon and to possibly cover at least part of the ankle of an athlete when the sports shoe 400 is worn. The rim of the collar portion 403 is connected on two sides 405 with the instep portion 402. In particular, the rim of the collar portion 403 is connected to the instep portion 402 at the lateral side and the medial side of the upper 401. As the collar portion 403 and the instep portion 402 are made of knitted material, they can be sewn together at locations 405*a* and 405*b* respectively at the two sides 405.

A main advantage of the upper 401 comes through the second connections 404 from the edge of the instep portion 402 with the collar portion 403. These connections may be sewn. The connections, and in particular the seams 404, are located in the heel area at the height of the ankles or below the ankles of an athlete wearing the sports shoe 400 and are responsible for a partial overlapping of the collar portion 403 and the instep portion 402. Via this connection in the heel area near the ankles of an athlete's foot a secure wearing comfort can be guaranteed.

In particular, in the overlapping areas, the instep portion 402 defines an interior surface of the upper 401 while the collar portion 403 defines an exterior surface of it. The dotted line shown in FIG. 4B illustrates the extension of the instep portion 402 inside the collar portion 403 in an overlapping area.

The fact that the collar portion 403 and the instep portion 402 are connected only at selected points or areas, and therefore are separated by a gap between them in the remaining areas, allows a higher stretchability of both portions in the areas that are not connected, thus allowing the upper 401 to easily stretch when a user is stepping in the shoe 400.

In some embodiments, the collar portion 403 comprises a piece, which is arranged at a medial side of the upper and another piece arranged at a lateral side of the upper.

The medial piece and the lateral piece are preferably connected to each other at the heel area of the shoe upper, in particular at a back of the shoe. For example, the medial piece and the lateral piece can be sewed together along their back edges. The construction of the collar portion in two pieces allows a more precise shaping of the shoe upper 401 at the heel area, thus providing a better support to the athlete's feet. Moreover, the embodiments in which the pieces of the collar portion 403 are made of knitted fabrics also provide comfort and flexibility.

In some embodiments, the collar portion 403 can be made of one piece.

The instep portion 402 is partially surrounded by the collar portion 403 which provides a stable 3D construction using stitching's 404*a* and 404*b* located near the ankle, and more in general in the heel area, and stitching's 405*a* and 405*b* located in the area of the instep. This leads to a solid arrangement of the collar and instep portions and at the same time to an enhanced stretchability of the two portions as previously specified, without the need to use complex knitting techniques. Therefore, no complex knitting processes are needed, which can minimize production costs and time expenditure.

In the heel area, the collar portion 403 is designed to be high enough for covering the Achilles tendon of an athlete. Therefore, the collar portion 403 forms a highest point in the back of the foot and slopes towards the midfoot. In other words, from the heel area to the midfoot area of the upper 401, the distance between the rim of the collar portion 403 and a sole of the shoe gradually decreases. This causes the collar portion 403 in the back of the shoe to surpass the instep portion 402 and then reduces its height in the midfoot in such a way that the instep portion 402 surpasses the collar portion 403. Laces 406, shown in the embodiment of FIG. 4B, are optional.

In the following, some embodiments of the disclosure relating to an upper with a specific collar portion and instep portion are described.

In a first example, an upper for a sports shoe includes an instep portion and a collar portion, wherein the collar portion is partly connected to the instep portion such that the collar portion partially overlaps the instep portion.

In a second example, the upper according to example 1, wherein the collar portion includes a rim, and wherein part of the rim of the collar portion is connected to the instep portion.

In a third example, the upper according to one of examples 1-2, wherein the collar portion is connected to the instep portion at a midfoot area of the upper.

In a fourth example, the upper according to one of examples 1-3, wherein the collar portion includes a first piece and a second piece.

In a fifth example, the upper according to example 4, wherein the first piece is arranged at a medial side of the upper and the second piece is arranged at a lateral side of the upper.

In a sixth example, the upper according to example 5, wherein the first piece and the second piece are at least partly connected at a heel area of the shoe upper.

In a seventh example, the upper according to one of examples 5-6, wherein the first piece is partly connected to the instep portion at the medial side of the upper, and wherein the second piece is partly connected to the instep portion at the lateral side of the upper.

In an eighth example, the upper according to one of example 1-7, wherein the collar portion includes a rim and a distance between the rim of the collar portion and a sole portion of the upper increases from a midfoot area of the upper to a heel area of the upper.

In a ninth example, the upper according to example 8, wherein in the rearfoot area a distance between the rim of the collar portion and the sole portion is greater than a distance between the instep portion and the sole portion.

In a tenth example, the upper according to one of examples 1-9, wherein the collar portion is adapted to cover a wearer's Achilles tendon at least partially.

In an eleventh example, the upper according to one of examples 1-10, wherein the upper includes a knitted fabric.

In a twelfth example, the upper according to one of examples 1-11, wherein the upper is a lace-less upper.

In a thirteenth example, a shoe includes an upper according to one of examples 1-12, and a sole attached to the upper.

In the following, embodiments of the further aspect of the disclosure relating to an upper with a specific shape of protrusion are described.

In a fourteenth example, an upper for a sports shoe includes at least one protrusion on an outer surface of the upper, wherein the at least one protrusion comprises a deltoid-shaped or circular base area and forms at least one peak extending from the outer surface of the upper.

In a fifteenth example, the upper according to example 14, wherein the deltoid-shaped base area includes convex deltoid and/or concave deltoid.

In a sixteenth example, the upper according to one of examples 14-15, wherein the deltoid-shaped base area includes two adjacent sides of a first length and two adjacent sides of a second length differing from the first length.

In a seventeenth example, the upper according to one of examples 14-16, wherein the at least one protrusion includes at least one notch such that the at least one protrusion includes at least two peaks.

In an eighteenth example, the upper according to one of examples 14-17, wherein the upper includes at least one protrusion in each of a medial area, a lateral area, an instep area, a heel area, a collar area, and a toe area.

In a nineteenth example, the upper according to example 18, wherein the at least one protrusion in different areas comprises different shapes and/or materials.

In a twentieth example, the upper according to example 19, wherein the at least one protrusion in the lateral area, the medial area, and the toe area includes one peak, and wherein the at least one protrusion in the instep area and the heel area includes at least one peak.

In a twenty-first example, the upper according to one of examples 14-20, wherein the at least one protrusion includes rubber, CPU, and/or silicon.

In a twenty-second example, the upper according to example 21, wherein the at least one protrusion in the lateral area, the medial area, and the toe area includes rubber.

In a twenty-third example, the upper according to example 22, wherein the at least one protrusion in the instep area, the heel area, and the collar area includes CPU and/or silicon.

In a twenty-fourth example, the upper according to one of examples 14-23, wherein the at least one protrusion is flexible.

In a twenty-fifth example, the upper according to one of embodiments 14-24, wherein the upper includes at least two protrusions with different hardness.

In a twenty-sixth example, a shoe includes an upper according to one of examples 14-25, and a sole attached to the upper.

What is claimed is:

1. An upper for a sports shoe, the upper comprising:

a plurality of areas comprising a medial area, a lateral area, a toe area, an instep area, a heel area, and a collar area; and at least one protrusion in at least four of the plurality of areas, wherein the protrusions protrude from an outer surface of the upper, and wherein the protrusions each comprise a deltoid-shaped base area with two adjacent sides comprising a first length, and two opposing adjacent sides comprising a second length different than the first length, wherein the protrusions are orientated such that the two adjacent sides comprising the first length are closer to a toe end of the upper than the two opposing adjacent sides comprising the second length, and wherein the first length is shorter than the second length.

2. The upper according to claim 1, wherein the upper comprises at least one protrusion in the medial area, the lateral area, the toe area, and the instep area.

3. The upper according to claim 2, wherein the protrusions in the lateral area, the medial area, and the toe area comprise rubber.

4. The upper according to claim 1, wherein the upper comprises at least one protrusion in the medial area, the lateral area, the toe area, the instep area, and the heel area.

5. The upper according to claim 1, wherein the at least one protrusion in a first of the plurality of areas differs from the at least one protrusion in a second of the plurality of areas in dimension, shape, or orientation.

6. The upper according to claim 1, wherein the upper comprises a plurality of the protrusions in a first and a second of the plurality of areas, and wherein a distribution density of the protrusions in the first area differs from a distribution density of the protrusions in the second area.

7. The upper according to claim 1, wherein the upper comprises at least two of the protrusions in at least one of the plurality of areas, and wherein the at least two protrusions differ in dimension, shape, or orientation.

8. The upper according to claim 1, wherein the upper comprises a plurality of the protrusions in at least one of the plurality of areas, and wherein the plurality of protrusions are unevenly distributed in the at least one of the plurality of areas.

9. The upper according to claim 1, wherein the upper comprises a plurality of the protrusions in at least one of the plurality of areas, and wherein two adjacent protrusions in the at least one of the plurality of areas have the same orientation.

10. The upper according to claim 9, wherein two non-adjacent protrusions in the at least one of the plurality of areas have different orientations.

11. The upper according to claim 1, wherein the upper comprises a base material which forms a mounting for the at least one protrusion.

12. The upper according to claim 11, wherein the base material forms the outer surface of the upper.

13. The upper according to claim 11, wherein the base material of the upper comprises a textile or a synthetic material.

14. The upper according to claim 11, wherein the base material of the upper comprises a first stretchability in a first of the plurality of areas and a second stretchability in a second of the plurality of areas, and wherein the first and second stretchabilities are different.

15. The upper according to claim 1, wherein the at least one protrusion comprises rubber, casting polyurethane, or silicon.

16. The upper according to claim 1, wherein the upper comprises protrusions in the instep area, the heel area, and the collar area, and wherein the protrusions in the instep area, the heel area, and the collar area comprise casting polyurethane or silicon.

17. The upper according to claim 1, wherein the at least one protrusion in at least one of the plurality of areas comprises a plurality of protrusions, and wherein the plurality of protrusions forms a channel configured to remove moisture from the surface of the upper.

18. The upper according to claim 1, wherein the collar area overlaps the instep area, and wherein the collar area and instep area are separate pieces of material that are connected to each other at multiple spaced apart locations such that there is a gap between the instep area and the collar area where the instep area and the collar area overlap and are not connected.

19. The upper according to claim 1, wherein the protrusions comprise a first point at an intersection of the two adjacent sides comprising the first length, and a second point at an intersection of the two opposing adjacent sides comprising the second length, and wherein a first one of the protrusions in the medial area has a first orientation and a second one of the protrusions in the medial area has a second orientation different from the first orientation, wherein, in the first orientation, the first point is closer to the lateral area than the second point, and, in the second orientation, the second point is closer to the lateral area than the first point, and wherein the first one of the protrusions is located rearward of the second one of the protrusions.

20. The upper according to claim 1, wherein the protrusions comprise sloping sides extending away from the deltoid-shaped base to a peak.

21. A shoe comprising:

an upper having a plurality of areas, the plurality of areas comprising a medial area, a lateral area, a toe area, and an instep area, wherein the plurality of areas each include a plurality of distinct, spaced-apart protrusions protruding from an outer surface of the upper, and at least one of the protrusions comprises a deltoid-shaped base area, a shape comprising two peaks, and a concave rise between the two peaks, wherein each peak comprises sloping side walls extending from the deltoid-shaped base area to a top of the peak; and a sole attached to the upper.

22. The shoe according to claim 21, further comprising a collar area, wherein the collar area comprises a rim, and wherein a distance between the rim of the collar area and the sole continuously increases from the lateral area of the upper to a heel area of the upper.

23. An upper for a sports shoe, the upper comprising:

a plurality of areas comprising a medial area, a lateral area, a toe area, an instep area, a heel area, and a collar area, wherein the collar area extends around an opening of the upper, and wherein the heel area comprises an ankle area and an area configured to wrap around a wearer's heel during use;

a first plurality of protrusions of a first size in at least one of the medial area, the lateral area, the toe area, and the instep area; and a second plurality of protrusions of a second size larger than the first size in the ankle area, the area configured to wrap around the wearer's heel during use, and the collar area, wherein the first and second plurality of protrusions protrude from an outer surface of the upper, and wherein the first and second plurality of protrusions comprise a deltoid-shaped base area and sloping side walls that extend from the deltoid-shaped base area to a peak.

* * * * *